US008083650B2

(12) United States Patent
Ozawa et al.

(10) Patent No.: US 8,083,650 B2
(45) Date of Patent: Dec. 27, 2011

(54) EXERCISE ASSISTING DEVICE

(75) Inventors: Takahisa Ozawa, Katano (JP); Youichi Shinomiya, Ibaraki (JP); Kazuhiro Ochi, Osaka (JP); Takao Gotou, Hirakata (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/810,047

(22) PCT Filed: Dec. 24, 2008

(86) PCT No.: PCT/JP2008/073431

§ 371 (c)(1),
(2), (4) Date: Jun. 22, 2010

(87) PCT Pub. No.: WO2009/081938

PCT Pub. Date: Jul. 2, 2009

(65) Prior Publication Data

US 2010/0273618 A1 Oct. 28, 2010

(30) Foreign Application Priority Data

Dec. 25, 2007 (JP) ..... 2007-333241

(51) Int. Cl.
*A63B 22/00* (2006.01)

(52) U.S. Cl. ..... 482/51; 482/52

(58) Field of Classification Search ..... 482/51–53, 482/79–80, 8; 601/23–27, 29, 32, 33–36
See application file for complete search history.

(56) References Cited

U.S. PATENT DOCUMENTS 3,572,699 A * 3/1971 Nies ..... 482/5
3,745,990 A * 7/1973 Neis ..... 600/595
(Continued)

FOREIGN PATENT DOCUMENTS

JP 2005-58733 A 3/2005
(Continued)

OTHER PUBLICATIONS

International Search Report for the Application No. PCT/JP2008/073431 mailed Feb. 3, 2009.

*Primary Examiner* — Stephen Crow
(74) *Attorney, Agent, or Firm* — Cheng Law Group, PLLC

(57) ABSTRACT

An exercise assisting device comprises foot supports having foot support surfaces respectively, a seat, a seat height adjusting unit, and a seat driving unit. The foot support is provided for bearing foot of a user. The seat is shaped to have a contact surface for supporting buttocks of the user when the user places the feet onto the foot support surfaces. The seat height adjusting unit is configured to move the seat toward a vertical direction and also toward a front-back direction in order to position the seat at a standard position which is located at a standard height from the foot support surface in the vertical direction. Consequently, a knee of the user has a predetermined angle. The seat driving unit is configured to swing the seat about the standard position so as to vary weight of the user which acts on legs of the user. The exercise assisting device further comprises a load regulating means. The load regulating means is configured to vary a load which acts on a knee joint of the user as a height between the contact surface of the seat and the foot support surface in the vertical direction becomes shorter than the standard height.

9 Claims, 11 Drawing Sheets

U.S. PATENT DOCUMENTS

| | | | | |
|---|---|---|---|---|
| 3,824,993 | A * | 7/1974 | Grant | 601/36 |
| 3,964,742 | A * | 6/1976 | Carnielli | 482/7 |
| 5,035,418 | A * | 7/1991 | Harabayashi | 482/62 |
| 5,050,865 | A * | 9/1991 | Augspurger et al. | 482/2 |
| 5,312,311 | A * | 5/1994 | Pearson | 482/57 |
| 5,890,996 | A * | 4/1999 | Frame et al. | 482/8 |
| 6,001,071 | A * | 12/1999 | Butler | 601/36 |
| 6,027,432 | A * | 2/2000 | Cheng | 482/57 |
| 6,220,991 | B1 * | 4/2001 | Sellers | 482/62 |
| 6,306,108 | B1 * | 10/2001 | Butler | 601/36 |
| 6,893,386 | B2 * | 5/2005 | Charoenchit | 482/142 |
| 6,908,416 | B2 * | 6/2005 | Mercado et al. | 482/52 |
| 7,083,547 | B2 * | 8/2006 | LaStayo et al. | 482/8 |
| 7,381,162 | B2 * | 6/2008 | Kuo | 482/57 |
| 7,399,259 | B2 * | 7/2008 | Somwong | 482/57 |
| 7,588,518 | B2 * | 9/2009 | LaStayo et al. | 482/63 |
| 7,662,070 | B1 * | 2/2010 | Mann | 482/57 |
| 2003/0153436 | A1 * | 8/2003 | Ho | 482/63 |
| 2006/0229170 | A1 | 10/2006 | Ozawa et al. | |
| 2007/0281834 | A1 * | 12/2007 | Lai | 482/57 |
| 2009/0017990 | A1 | 1/2009 | Ochi et al. | |

FOREIGN PATENT DOCUMENTS

| | | | |
|---|---|---|---|
| JP | 2006-325999 | A | 12/2006 |
| JP | 2007-89650 | A | 4/2007 |
| JP | 2007-89652 | A | 4/2007 |
| WO | WO-2004/110568 | A1 | 12/2004 |

* cited by examiner

EXERCISE ASSISTING DEVICE

TECHNICAL FIELD

This invention relates to an exercise assisting device of passive type. The exercise assisting device comprises a driving source being configured swing the seat for displacing the seat in a condition where the user's buttocks is supported by the seat and the user's feet are placed on the foot support surfaces.

BACKGROUND ART

Japanese patent application publication No. 2005-058733A and Japanese patent application publication No. 2007-89650A discloses prior exercise assisting devices. The prior exercise assisting device is used by the user in a condition where the user sits on the seat for placing the buttocks on the seat and also the user places the user's feet on the foot support surfaces. When the seat is displaced, muscles of the femoral areas of the user is expanded and contracted while the user hardly bends the knee. In this exercise assisting device, a position of the seat is displaced for varying the ratio of the weight of the user which is supported by the seat, whereby the exercise assisting device varies the ratio of the weight of the user which acts on the legs of the user.

The prior exercise assisting device is configured to apply load lower than the total weight of the user to the user's legs. Furthermore, the prior exercise assisting device is configured to expand and contract the muscles of the femoral areas while the user hardly bends and stretches the user's knees. Therefore, persons having diabetes and also knee pains are able to use the exercise assisting device, whereby the persons having diabetes and also knee pains is able to enhance the muscles of the femoral areas. The femoral areas have large volumes. Therefore, when the user expands and contracts the muscles by using the exercise assisting device, the user is able to improve adult disease. Moreover, the exercise assisting device comprises the seat which is configured to be swung. Therefore, the user is passively exercised without using the muscles actively. Consequently, the user having low exercise capacity is able to exercise by the exercise assisting device. In addition, the user having low motivation for exercise is able to exercise by the exercise assisting device.

By the way, the prior exercise assisting device is configured to vary the user's weight acting on the user's legs to tighten and relax the muscles of the femoral areas while hardly bending and stretching the user's knee. Therefore, effective exercise depends on the bending angle which acts as a factor of tensing and relaxing the muscles of the femoral areas. As easily understood from the squat motion, the load applied to the femoral areas of the muscles is varied according to the bending angle of the knee. However, when the user having the knee pain bends the knees, the user having the knee pain feels pain in the knee of the user. Therefore, it is required for the exercise assisting device to restrict the bending angle of the knees of the user when the user having the knee pain uses the exercise assisting device.

In the present circumstances, it is thought that the suitable angle of the bending angle of the knee is determined as approximately 140 degrees. The 140 degrees of the suitable angle is based upon experimental results of the exercise effect which is maximized when the bending angles of the knees are approximately 140 degrees.

In addition, also according to the experimental result, the knee pain is minimized when the bending angle of the knees are approximately 140 degrees. It should be noted that the bending angle of the knee is defined by the angle made by the femoral area and the leg region in the front side of the knee.

DISCLOSURE OF THE INVENTION

Problem to be Solved by the Invention

By the way, in a case where the user having no knee pain, the user preferably exercises with knee angle at less than 140 degrees (in particularly, 130 to 120 degrees) because it is possible to enhance the exercise effect. However, when the prior exercise assisting device is used by the user with the knee angle at less than appropriate angle, there is a possibility of applying the exceeding load to the knee joint. That is, there is a possibility of applying negative effect to the knee joint. In addition, it is desirable to exercise not one knee angle but wide knee angle.

This invention is achieved to solve the problem. An object in this invention is to provide an exercise assisting device which allows the user to exercise effectively and safely with wide knee angle while applying no exceeding load to the knee joint.

Means of Solving the Problem

In order to solve the above problem, the exercise assisting device in this invention comprises foot supports, a seat, a seat height adjusting unit, and a seat driving unit. The foot supports has foot support surfaces respectively. Each the foot support is provided for bearing a foot of a user. The seat is shaped to have a contact surface for supporting buttocks of the user when the user places the feet onto the foot support surfaces. The seat height adjusting unit is configured to move the seat toward a vertical direction and also toward a front-back direction in order to position the seat at a standard position. The standard position is located at a standard height measured from the foot support surface in the vertical direction. Consequently, a knee of the user has a predetermined angle. The seat driving unit is configured to swing the seat about the standard position so as to vary weight of the user which acts on legs of the user. The exercise assisting device further comprises a load regulating means. The load regulating means is configured to vary a load which acts on a knee joint of the user as a height between the contact surface of the seat and the foot support surface in the vertical direction becomes shorter than the standard height.

In this case, the load regulating means is configured to reduce the load applied to the knee joint of the user according to the distance between the contact surface of the seat and foot supports corresponding to the bending angle of the knee of the user. In other words, as the bending angle of the knee of the user becomes smaller, the load applied to the knee joint is reduced by the load regulating means. Therefore, it is possible to obtain the exercise assisting device being configured to give the exercise to the user without applying exceeding load to the knee joint, and being configured to give the exercise to the user safely and effectively with a broad angle range of the joint angle.

It is preferred that the seat driving unit is configured to swing the seat at a variable cycle. The seat driving unit is configured to swing the seat about the standard position at a predetermined cycle when said seat is located at the standard height from said foot support surface. The load regulating means is configured to control the seat driving unit such that the seat driving unit swings the seat at a cycle longer than the predetermined cycle as the height of the seat from the foot support surface becomes shorter than the standard height.

In this case, the acceleration of the movement of the weight center of the user caused by the swing of the seat is reduced by means of prolonging the cycle for displacing the seat. Consequently, it is possible to reduce the weight applied to the leg. Therefore, it is possible to obtain the exercise assisting device being configured to reduce the load applied to the knee joint.

It is preferred that the seat driving unit is configured to swing the seat about the standard position so as to displace the seat at a displacement amount which is variable. The seat driving unit is configured to swing the seat at a predetermined displacement amount when the seat is located at the standard height from the foot support surface. The load regulating means is configured to control the seat driving unit such that the seat driving unit swings the seat at a displacement amount lesser than the predetermined displacement amount as the height of the seat from the foot support surfaces becomes shorter than the standard height.

In this case, the load applied to the leg is reduced by reducing the displacement amount of the seat. Consequently, the load applied to the knee joint is reduced. Therefore, it is possible to obtain the exercise assisting device being configured to reduce the load applied to the knee joint.

It is preferred that the seat is shaped to have the contact surface which has a predetermined area when the seat has the standard height. The load regulating means is configured to increase an area of the contact surface in order to increase a contact area between the seat and the buttocks as a height of the seat from the foot support surface becomes shorter than the standard height.

In this case, the seat is configured to increase the contact area with respect to the buttocks according to the height of the seat from the foot support surface. To increase the contact area between the seat and the buttocks makes it possible for the seat to support much of the weight of the user. Consequently, the load applied to the legs is reduced. As a result, the load applied to the knee joint is reduced. That is, it is possible to obtain the exercise assisting device being configured to reduce the load applied to the knee joint.

It is preferred that the load regulating means is configured to incline the seat toward a back direction as a height of the seat from the foot support surface becomes shorter than the standard height.

In this case, the seat driving unit is controlled to incline the seat backward so as to support much of the weight of the user. Therefore, the load applied to the leg is reduced. As a result the load applied to the knee joint is reduced. That is, it is possible to obtain the exercise assisting device being configured to reduce the load applied to the knee joint.

It is preferred that the load regulating means comprises a detector and a controller. The detector is configured to detect muscle activities of the legs of the user. The controller is configured to control the seat height adjusting means such that the seat is positioned to have an adjusted height which is determined on the basis of the muscle activities of the legs of the user.

In this case, the detector is configured to detect the muscle activities of the legs. The controller estimates the load applied to the legs of the user on the basis of the muscle activities of the legs detected by the detector, and subsequently controls the seat height adjusting unit to adjust the position of the seat in the vertical direction. In other words, the controller estimates the load applied to the legs of the user and adjusts the bending angle of the knee joint of the user. Consequently, it is possible to obtain the exercise assisting device being configured to give the load to target muscles while keeping the safety.

It is preferred that the detector is configured to detect the muscle activity of specified muscle. The specified muscle I at least one of a rectus femoris muscle, a medial great muscle, and a lateral vastus muscle.

These and still other objects and advantages will become apparent from the following best mode for carrying out the invention referring to the attached drawings.

BRIEF EXPLANATION OF THE DRAWING

In FIG. 9*a*, the seat driving unit is simplified.

BEST MODE FOR CARRYING OUT THE INVENTION

First Embodiment

Figure 1:
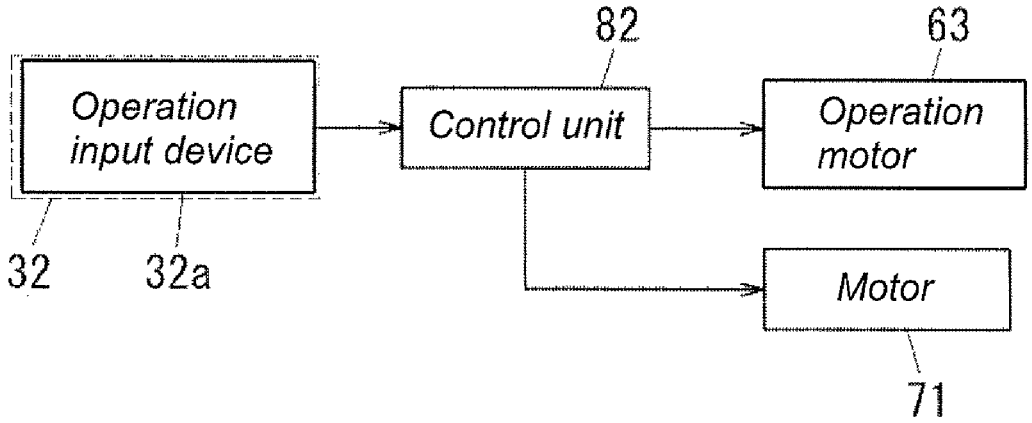
FIG. 1 shows a block diagram of essential part of the first embodiment in this invention.
Figure 2:
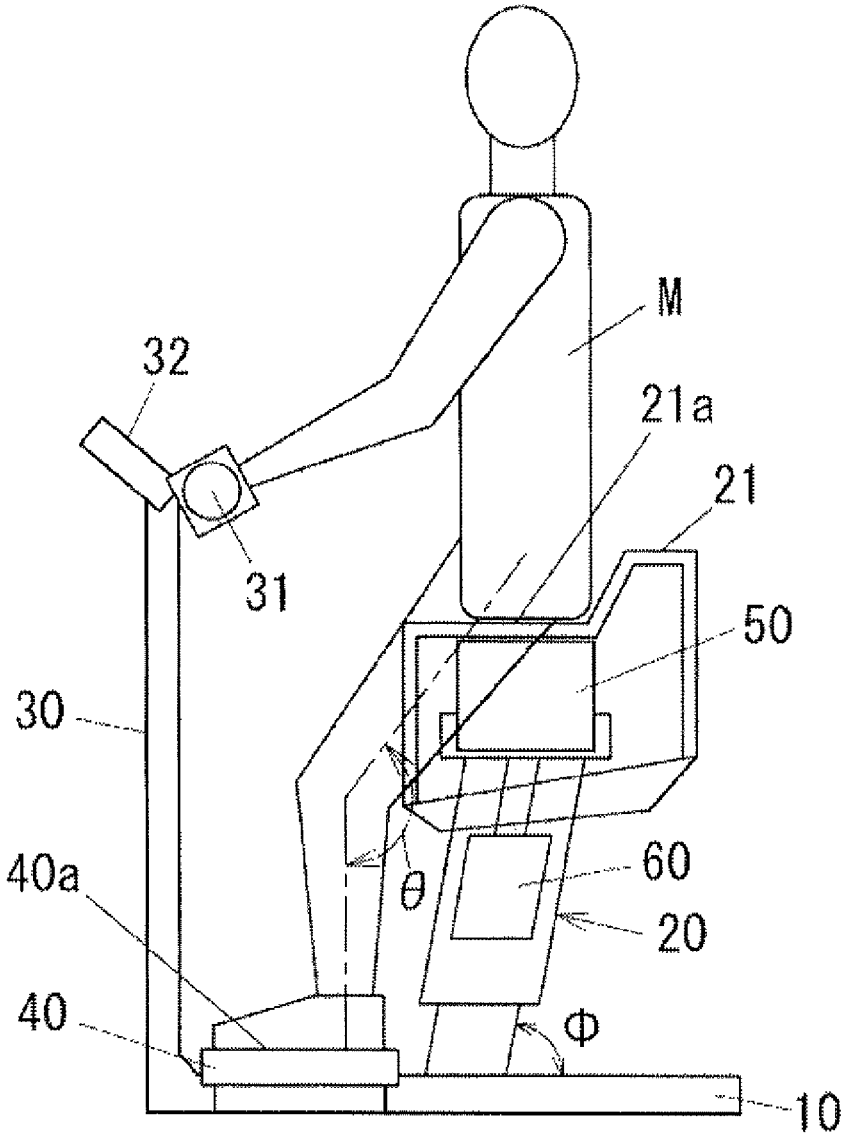
FIG. 2 shows a schematic side view of the first embodiment in this invention.
Figure 3:
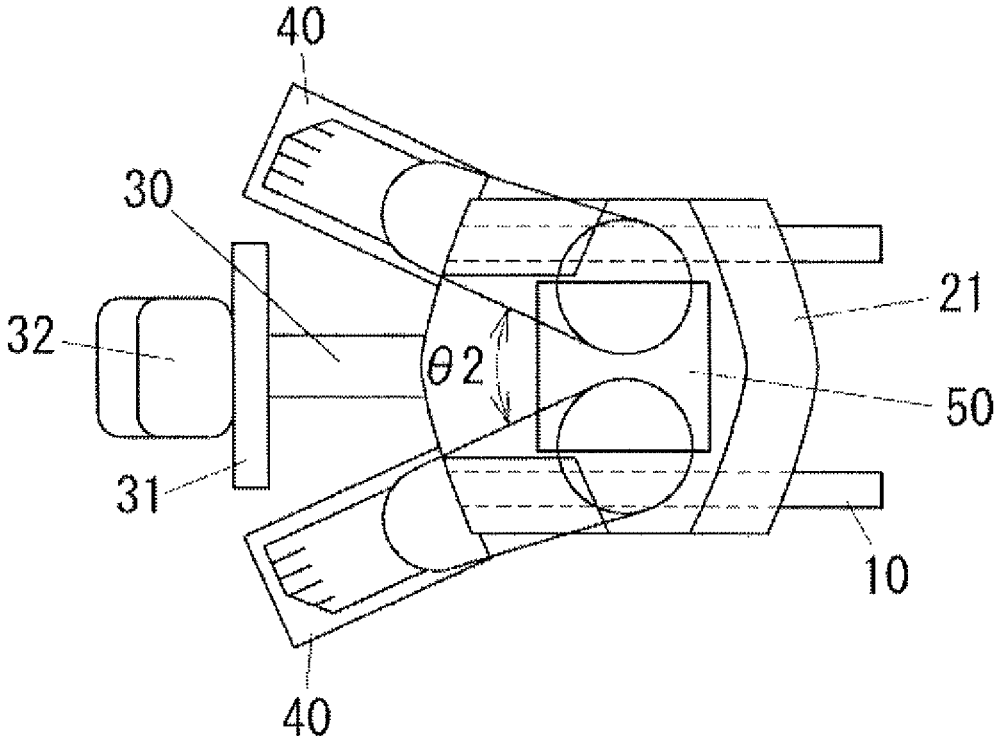
FIG. 3 shows a schematic top view of the first embodiment in this invention.

FIG. 2 and FIG. 3 show an exercise assisting device in this embodiment. The exercise assisting device comprises a base 10, a seat 21, a seat support 20, a handle 31, and a handle post 30. The base 10 is disposed on a fixed position such as a floor. The seat support 20 is disposed on the base 10. The seat 20 is disposed on the top of the seat support 21. The seat 20 is shaped to support buttocks of the user M. The handle 31 is adapted to be held by the user M as necessary. The handle 31 is disposed on the top end of the handle post 30. The base 10 is provided with foot supports 40. Each the foot support 40 is located between the seat support 20 and the handle post 30. Each the foot support 40 is provided at its top with a foot support surface 40*a*. The foot support surface 40*a* of the foot support 40 is shaped to bear the foot of the user M, whereby the foot support surface 40*a* determines the position of the foot.

The seat support 20 comprises a seat driving unit 50 and a seat height adjusting unit 60. The seat driving unit 50 is configured to swing the seat 21. The seat height adjusting unit 60 is configured to raise and lower the seat 20 relative to the base 10. The seat height adjusting unit 60 is configured to move the seat 21 to a standard position. The seat driving unit 50 is configured to swing the seat 21 about the standard position. The standard position is located at a standard height from the foot support surface. Components of the seat driving unit 50 and the seat height adjusting unit 60 are explained later.

When the user M uses the exercise assisting device, the user sits on the contact surface 21*a* of the seat 21 and the user places the user's feet on the foot support surfaces 21*a*. In this situation, the seat driving unit 50 swings the seat 21 about the standard position so as to vary the position of the user's buttocks by means of the driving source. Consequently, the seat driving unit 50 varies the user's weight which acts on the legs. That is, in the condition where the user's weight is distributed to the user's buttocks and the user's legs, the seat driving unit 50 varies the position of the buttocks. In this manner, the seat driving unit varies the user's weight which acts on the user's buttocks. As a result, the seat driving unit 50 varies the user's weight which acts on the user's legs. The seat driving unit 50 is configured to swing the seat 21 about the standard position at a variable cycle. When the seat 21 is located at the standard height from the foot support surface 40*a*, the seat driving unit 50 swings the seat 21 at a predetermined cycle. In addition, the seat driving unit is configured to swing the seat 21 about the standard position so as to displace the position of the seat at a variable displacement amount. When the seat 21 is located at the standard height from the foot support surface 40*a*, the seat driving unit 50 swings the seat 21 so as to displace the seat 21 at a predetermined displacement amount.

Under a situation where the user bends the knee (knee joint) at a predetermined angle, when the ratio of the user's weight supported by the seat 21 is decreased, the load acting on the user's femoral areas is increased. This exercise is similar to the squat exercise while bending the knees. Consequently, the muscles of the femoral areas are contracted and stretched. That is, when driving source swings the seat 21, the muscles of the user's femoral areas is tensed and relaxed passively, not actively by the user M. In short, the seat driving unit 50 swings the seat 21, thereby exercising the muscles of the femoral areas mainly.

It is desired that the seat 21 is configured to be swung in a direction such that the swing of the seat causes no shear force to the knee joint. Under the condition where the user's buttocks is supported by the contact surface 21*a* of the seat 21, the user M is able to maintain natural posture when the distance between the toes is greater than the distance between the heels, shown in FIG. 3. An opening angle θ2 made by the left foot and the right foot is able to be determined by the position of the foot supports 40 where the user places the feet. In view of this, the seat is driven to move in a direction along a center line which passes through the heel to the toe of each the foot on the foot support 40. Consequently, the exercise assisting device is configured to give the exercise to the user without applying the shear force to the knee joint. That is, the seat 21 is driven to move within the swing range which has a front-end and a back-end. In addition, the seat 21 has a first period and a second period when the seat 21 is driven to move from the back-end to the front-end. In the first period, the seat 21 is moved toward a diagonally forward left when the seat is driven to move from the back-end to the front-end. In the second period, the seat 21 is moved toward a diagonally forward right when the seat 21 is driven to move from the back-end to the front-end. Consequently, the exercise assisting device causes the user's weight to apply the femoral areas of the user's left leg and the user's right leg without applying the shear force to the knee joints. In addition, the exercise assisting device further comprises a descending mechanism. The descending mechanism is configured to descend the foot support surface 40*a* of the foot supports 40 as the seat 21 is swung. Consequently, a relative distance between the position of the seat and the position of the foot is kept constant. As a result, the exercise assisting device is capable of giving the exercise to the user without varying the angle of the knee joint. In this manner, the shear forces applied to the knee joints is reduced.

It is noted that FIG. 2 shows the contact surface 21*a* defined by the top surface of the seat 21 is approximately parallel to a horizontal plane. However, the exercise assisting device is configured to vary the user's weight which acts on the legs of the user M so that the exercise assisting device allows the muscles of the femoral areas to contract. Therefore, it is desired that the contact surface 21*a* for supporting the buttocks of the user M is inclined with respect to the horizontal plane so as to have a frontward tilting posture in the front direction within the swing range. That is, it is preferred to employ the seat 21 being provided at its front end with a right buttock supporting surface and a left buttock supporting surface. The right buttock supporting surface for supporting the right buttock of the user M has the frontward tilting posture of inclining toward a front direction and a right direction. The left buttock supporting surface for supporting the left buttock of the user M has the frontward tilting posture of inclining toward a front direction and a left direction. Consequently, it is possible to increase the user's weight acting on the legs when the seat 21 moves from the back-end position toward a front direction within the swing range. That is, this configuration makes it possible for the exercise assisting device being configured to increase the load acting on the load easily. Therefore, the exercise effect given to the user by the exercise assisting device is enhanced.

The top end of the handle post 30 holds the handle 31. The handle 31 is provided at its center with an operation unit 32. The operation unit 32 is used for entering an operation instruction for operation of the seat driving unit 50 and the seat height adjusting unit 60. In addition, the handle 31 is adapted to be used by the user for stabilizing the position of the upper body of the user M.

Figure 4:
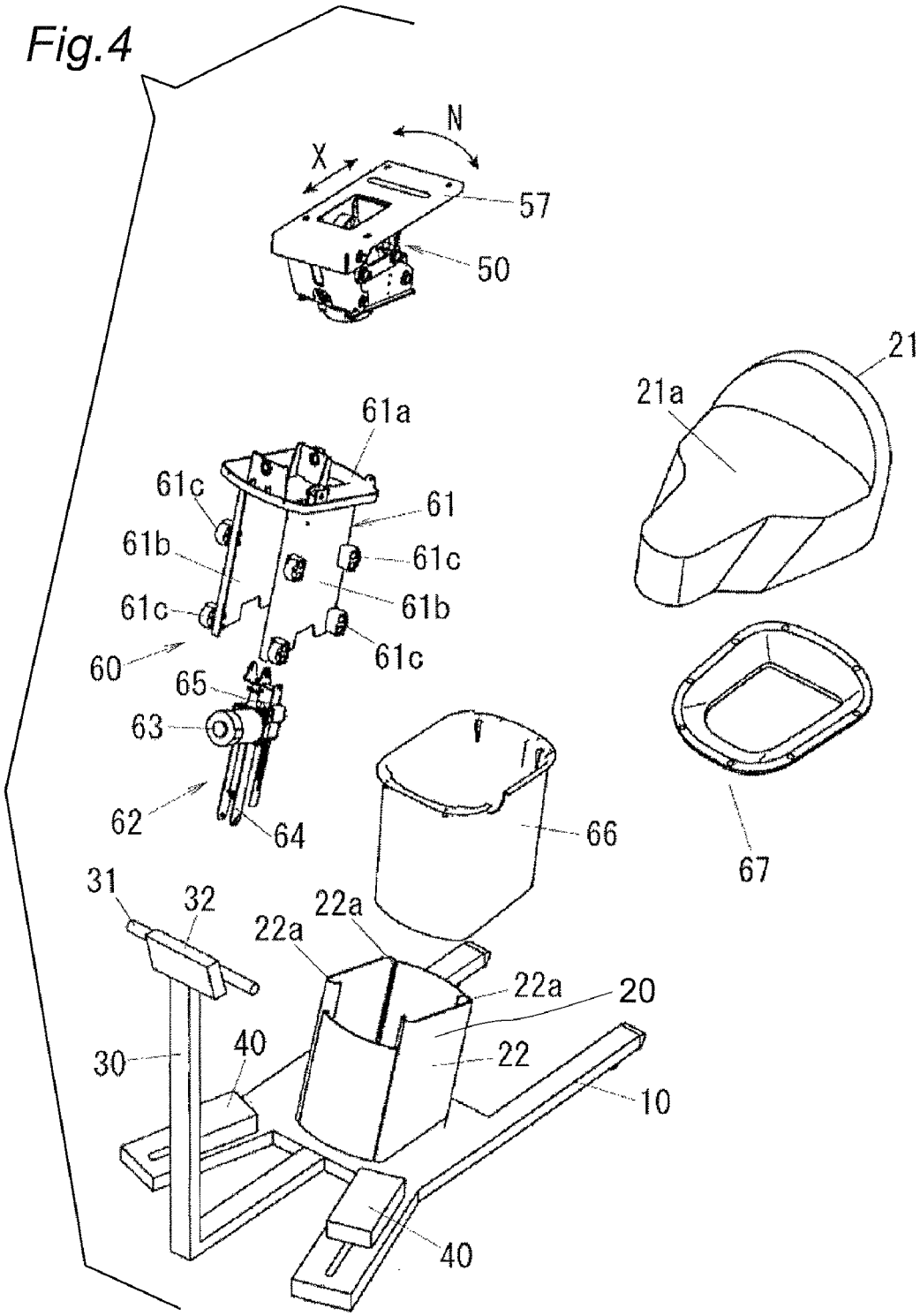
FIG. 4 shows an exploded perspective view of the first embodiment in this invention.

Hereinafter, a structure of the seat support 20 is specifically explained. FIG. 4 shows the seat support 20. The seat support 20 is disposed on the base 10. The seat support 20 comprises a support member 22 which is shaped to have a hollow structure. The support member 22 incorporates the lower end of the seat height adjusting unit 60 therein. The seat height adjusting unit 60 comprises a lifting base 61. The lifting base 61 is configured to slidably move in the vertical direction with respect to the support member 22. The lifting base 22 is provided at its top end with the seat driving unit 50. Therefore, the seat driving unit 50 and the seat 21 are configured to be movable relative to the base 10. Consequently, the seat height adjusting unit 60 is configured to move said seat driving unit 50 and said seat 21 to the standard position at the standard height measured from said foot support surface in the vertical direction.

The support member 22 has a center line. The center line of the support member 22 is a straight line. In addition, the center line is inclined backwardly with respect to the vertical direction. That is, the center line extends upwardly and backwardly. Consequently, the lifting base 61 slides within the support member 22. Therefore, the contact surface 21*a* is capable of being located in a position along the straight line of the center line of the support member 22 with respect to the vertical direction. In other words, the position of the contact surface 21*a* of the seat 21 is adjusted in the vertical direction, and is also adjusted in the front-back direction. The position of the contact surface 21*a* is located at a rear side as the position of the contact surface 21*a* is located at an upright position. An angle of the center line of the support member 22 with respect to the base 10 is mentioned below.

The lifting base 61 is moved in the vertical direction by means of the vertically elevation unit 62 which comprises an operation motor 63. The vertically elevation unit 62 is cooperative with the lifting base 61 to construct the seat height adjusting unit 60. Furthermore, the vertically elevation unit 62 comprises a fixing member 64 and a movable member 65. The fixing member 64 is fixed to the base 10. The movable member 65 comprises screws and is screwed to the fixing member 64. The speed of the rotation generated by the operation motor 63 is reduced, and subsequently given to the movable member 65 for rotating the movable member 65. Consequently, the movable member 65 is moved upward and downward. The lifting base 61 is attached to the top end of the movable member 65. When the movable member 65 moves upward and downward, the lifting base 61 is moved upward and downward.

The lifting base 61 comprises a pedestal 61*a* which is provided for mounting the seat driving unit 50. The pedestal 61*a* is provided at its lower surface with a pair of guide plates 61*b*. The movable member 65 of the vertically elevation unit 62 is coupled to the lower surface of the pedestal 61*a*. In addition, each the guide plate 61*b* is provided at its outer surface with a roller 61*c*. The support member 22 is provided at its inside with a rails 22*a* which guides the rollers 61*c*. Consequently, the lifting base 61 is configured to be movable with respect to the support member 22 smoothly.

The pedestal 61*a* of the lifting base 61 is covered by a lifting cover 66. The lifting cover 66 has a hollow shape. The lifting cover 66 is provided at its lower end with an overlapping section. The overlapping section is overlapped with an outer surface of the support member 22 in an extension area of the vertically elevation unit 62. This configuration prevents the lifting base 61 from being exposed to the outside when the vertically elevation unit 62 is maximally extended. In addition, a unit cover 67 is attached to the pedestal 61*a* of the lifting base 61. The unit cover 67 is made from the clothes which is flexible. The unit cover 67 is shaped to cover a space between the pedestal 61*a* and the seat 21. Consequently, the unit cover 67 prevents the seat driving unit 50 to be exposed to the outside.

Figure 5:
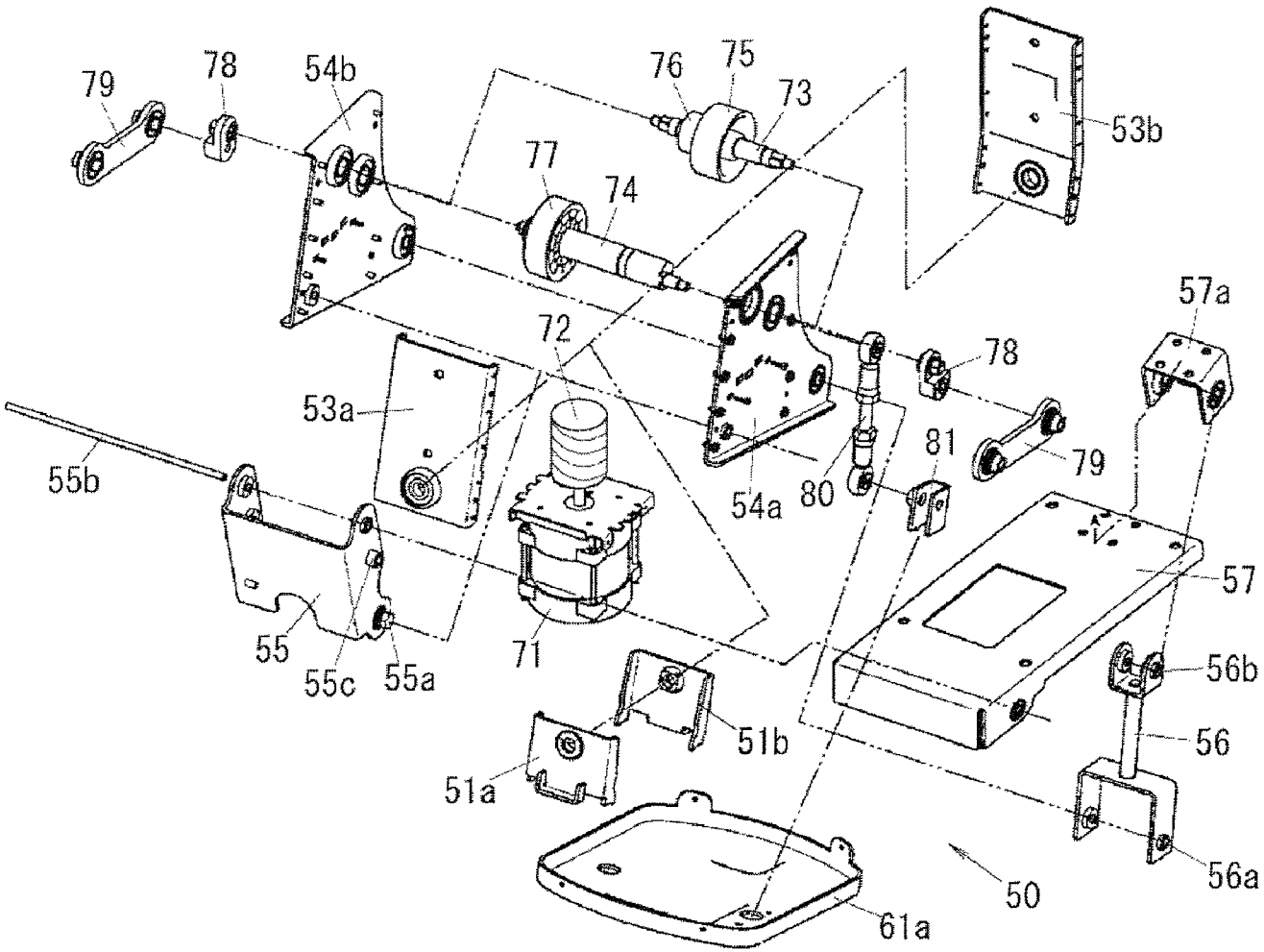
FIG. 5 shows an exploded perspective view of the seat driving unit of the first embodiment in this invention.
Figure 6:
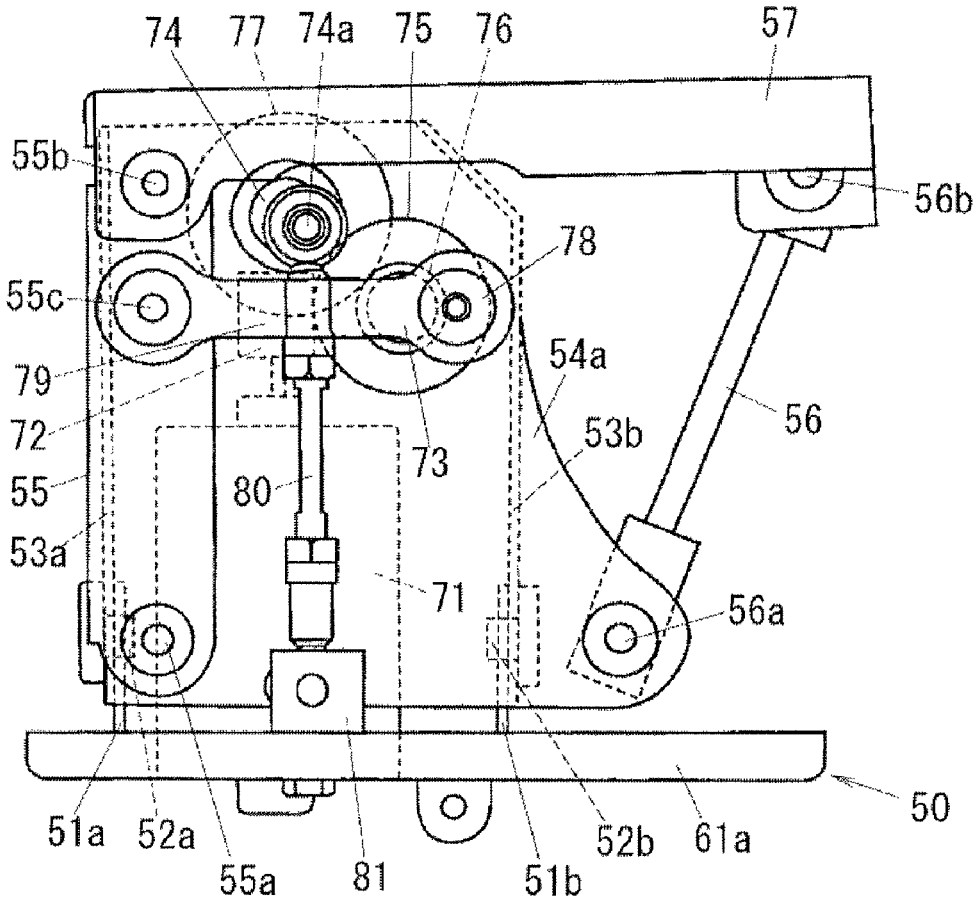
FIG. 6 shows a side view of the seat driving unit of the first embodiment in this invention.

Next, the seat driving unit 50 is explained on the basis of FIG. 5 and FIG. 6. The seat driving unit 50 is cooperative with the pedestal 61*a* of the lifting base 61 to construct a swing unit being configured to swing the seat 21. The pedestal 61*a* is provided at its top surface with a front shaft support 51*a* and a rear shaft support 51*b*. The seat driving unit 50 is provided with a front shaft 52*a* and a rear shaft 52*b*. The seat driving unit 50 is pivotally fixed to the pedestal 61*a* via the front shaft support 51*a* and the front shaft 52*a*, and the rear shaft support 51*b* and the rear shaft 52*b*. An axis line of the front shaft 52*a* is aligned an axis line of the rear shaft 52*b*. When the seat driving unit rotates about the front shaft 52*a* and the rear shaft 52*b*, the seat 21 (which is coupled to the seat driving unit 50) is swung in the lateral direction (indicated by an arrow of N in FIG. 4).

The seat driving unit 50 is provided with a front frame plate 53*a* and a rear frame plate 53*b*. The front frame plate 53*a* and the rear frame plate 53*b* are coupled to each other via a left frame plate 54*a* and a right frame plate 54*b*. Each one of the left frame plate 54*a* and the right frame plate 54*b* is pivotally fixed to a lower end of the front link 55 via a front shaft 55*a*. The front link 55 is configured to be rotatable about a lateral axis. Each one of the left frame plate 54*a* and the right frame plate 54*b* is pivotally fixed to a lower end of a rear link 56 via a rear shaft 56*a*. An upper end of the front link 55 is pivotally fixed to a base plate 57 via a front shaft 55*b*. An upper end of the rear link 56 is pivotally fixed to a base plate 57 via a rear shaft 56*b*. The upper end of the rear link 56 is not pivotally fixed to the base plate 57 directly. The upper end of the rear link 56 is pivotally fixed to a bearing plate 57*a* fixed to the base plate 57.

The front end of the base plate 57 is driven to move along a circular arc which has the front shaft 55*a* as a center of the circular arc. The rear end of the base plate 57 is driven to move along a circular arc which has the rear shaft 56*a* as a center of the circular arc. In this manner, a movable range of the base plate 57 is restricted. The rear link 56 is longer than the front link 55. Therefore, a radius gyration of the front end of the base plate 57 is different from a radius gyration of the rear end of the base plate 57. Consequently, when the base plate 57 moves in a front-back direction, the angle of the upper surface of the base plate 57 with respect to the horizontal plane is varied. In particular, FIG. 6 shows the base plate 57 having the back-end position of the movable range. When the base plate 57 moves forward, the front end of the base plate 57 is moved downward relative to the rear end of the base plate 57. Consequently, the angle of the upper surface of the base plate 57 with respect to the horizontal plane is increased. In contrast, when the base plate 57 moves backward, the front end of the base plate 57 is moved upward relative to the rear end of the base plate 57. Consequently, the angle of the upper surface of the base plate 57 with respect to the horizontal plane is diminished. That is, the base plate 57 is configured to be movable in the front-back direction. (The front-back direction is indicated by an arrow of X shown in FIG. 4.) It should be noted that FIG. 4 a linear movement of the base plate 57. However, the angle of the base plate 57 with respect to the horizontal plane in the front-back direction is varied. Therefore, the movement of the base plate 57 has a rotation movement and also the front-back direction movement.

The motor 71 for swinging the base plate 57 relative to the pedestal 61*a* is held by the left frame plate 54*a* and the right frame plate 54*b*. In addition, the motor 71 is arranged such that an output shaft of the motor 71 extends upward. The output shaft of the motor 71 is provided with a worm 72. The left frame plate 54*a* and the right frame plate 54*b* movably support a first shaft 73 and a second shaft 74. The first shaft 73 is provided with a worm wheel 75 which meshes with the worm 72. The second shaft 74 is provided with a gear 77. The first shaft is also provided with a gear 76 which meshes with the gear 77.

Both ends of the first shaft 73 hold eccentric cranks 78. The eccentric crank 78 is rotated when the first shaft 73 is rotated. Each the eccentric crank 78 is pivotally fixed to each first end of the arm link 79. Each second end of the arm link 79 is pivotally fixed to axial pins 55*c* which extend toward lateral directions from the front link 55.

With this configuration, when the first shaft 73 is rotated by the motor 71, the front link 55 is swung about the front shaft 55*a* so as to reciprocate in the front-back direction by the eccentric crank 78 and the arm link 79. The front end of the base plate 57 is swung about the front shaft 55*a* so as to move in the front-back direction (which is indicated by an arrow of X in FIG. 4). In addition, the rear link 56 is rotated about the rear shaft 56*a*. Therefore, the inclination angle between the top surface of the base plate 57 with respect to the horizontal plane is varied according to the movement of the front-back direction of the base plate 57.

In contrast, the second shaft 74 is provided at its first end with a eccentric pin 74*a*. The eccentric pin 74*a* is pivotally fixed to a first end of the eccentric rod 80. A second end of the eccentric rod 80 is coupled to the connecting fixing 81 attached to the pedestal 61*a*. It should be noted that it makes no difference whether the pin 74*a* and the eccentric rod 80 is attached to the left side of the seat driving unit 50 or the right side of the seat driving unit 50.

With this configuration, when the motor 71 is started, the motor 71 rotates the second shaft 74 through the first shaft 73. Consequently, the position of the height of the eccentric pin 74*a* relative to the pedestal 61*a* is varied by the pin 74*a* and eccentric rod 80. As a result, the base plate 57 is swung about the front shaft 52*a* and the rear shaft 52*b*, whereby the base plate 57 is swing in the lateral direction. (The lateral direction is indicated by an arrow of N shown in FIG. 4.)

The motor 71 is realized by a brushless DC motor. The operation motor 63 is also realized by a DC motor. The operation motor 63 is disposed within a storage space surrounded by the front frame plate 53, the rear frame plate 53*b*, the left frame plate 54*a*, the right frame plate 54*b*, the pedestal 61*a*, and the base plate 57. The gears 75, 76, and 77 are also disposed within the storage space. Consequently, the seat driving unit 50 is downsized.

The seat driving unit 50 is configured to move the seat 21 in two directions. A first direction of the two directions is defined by the front direction in combination with the right direction and the down direction. A second direction of the two directions is defined by the front direction in combination with the left direction and the down direction. However, with the above configurations, it is possible to vary a gear ratio of the gears 76 and 77, and the phase difference between the eccentric crank 78 and the eccentric pin 74*a* arbitrarily. Consequently, it is possible to move the seat 21 such that the seat 21 traces V-shape, W shape, and eight-shape. (When the seat is reciprocated once in a lateral direction while the seat is reciprocated twice in the front-back direction, the seat traces the V-shape. When the seat is reciprocated once in the lateral direction while the seat is reciprocated fourth in the front-back direction, the seat traces the W-shape. When the seat is reciprocated once in a lateral direction while the seat is reciprocated twice in the front-back direction and the back-end position is eccentrically located in the left side or the right side, the seat traces the eight-shape (8-shape).)

The operation motor 63 and the motor 71 is started and stopped by instructions entered by the operation unit 32. That is, the operation unit 32 is provided with an operation input device 32*a* for entering a start-stop instruction of starting or stopping the motor 71, and a height adjusting instruction of moving the seat 21 upward or downward in order to adjust the bending angle θ of the knee to a suitable angle.

By the way, as mentioned in the prior art, the exercise assisting device of the above mentioned is required to contract the muscles of the femoral areas without causing the knee pain to the user M having knee pain. In order to contract the muscles of the femoral areas without knee pain, it is necessary to keep the bending angle θ of the knee at a suitable angle. The suitable angle is, for example, 140 degrees. However, in order to enhance the effect of the muscle exercise, it is preferred to exercise the user with the bending angle of the knee at smaller than the suitable angle (140 degrees). In particular, it is preferred to exercise the user with the bending angle of the knee at 120 to 130 degrees.

As mentioned above, the height of the seat 21 is adjusted by the seat height adjusting unit 60. Therefore, the user is able to vary the height of the seat 21 so as to adjust the bending angle θ of the knee of the user M. That is, the seat height adjusting unit 60 is configured to move the seat 21 toward a vertical direction and a front-back direction in order to move the seat 21 to the standard position. Consequently, the bending angle of the knee of the user M is suitably adjusted. Then, the seat driving unit swings the seat 21 about the standard position. Consequently, the weight of the user acting on the user's legs is varied. The seat height adjusting unit 60 configured to move the seat 21 in a linear line inclined backwardly with respect to the base 10. Consequently, the contact surface 21*a* of the seat 21 is located backward as the contact surface 21*a* of the seat 21 is moved upward.

Hereinafter, relationship of the control between operation of the operation unit 32 and operation motor 63 (acting as the driving source of the seat height adjusting unit 60), motor 71 (acting as the driving source of the seat driving unit 50) is explained. The operation unit 32 comprises an operation input device 32*a*. The operation input device 32*a* is used for entering a height adjusting instruction, a position determination instruction, and a power on-off instruction. The height adjusting instruction is a command for moving the seat 21 upward and downward. The position determination instruction is a command for determining the position of the seat. The poser on-off instruction is a command for power on or power off the exercise assisting device.

The operation input device 32*a* comprises a plurality of operation switches which correspond to individual operation inputs. When the operation switch is operated, the operation input device 32 receives the operation input. When the operation input device 32 receives the operation input, the operation input device sends an operation signal corresponding to the operation input to the control unit 82 for controlling the seat height adjusting unit 60 and the seat driving unit 50. The control unit 82 is realized by an electrical circuit having a microcomputer as a main component. The control unit 82 controls the operation motor 63 and the motor 71 on the basis of the operation signal sent from the operation input device 32*a* of the operation unit 32. The control unit 82 controls the operation motor 63 to rotate at a low speed during a period where the control unit receives the operation signal for moving the seat 21 from the operation input device. Consequently, the control unit 82 moves the seat 21 upward or downward. It should be noted that when the operation input device 32*a* stops sending the operation signal, the control unit 82 stops the operation motor 63.

Figure 7:
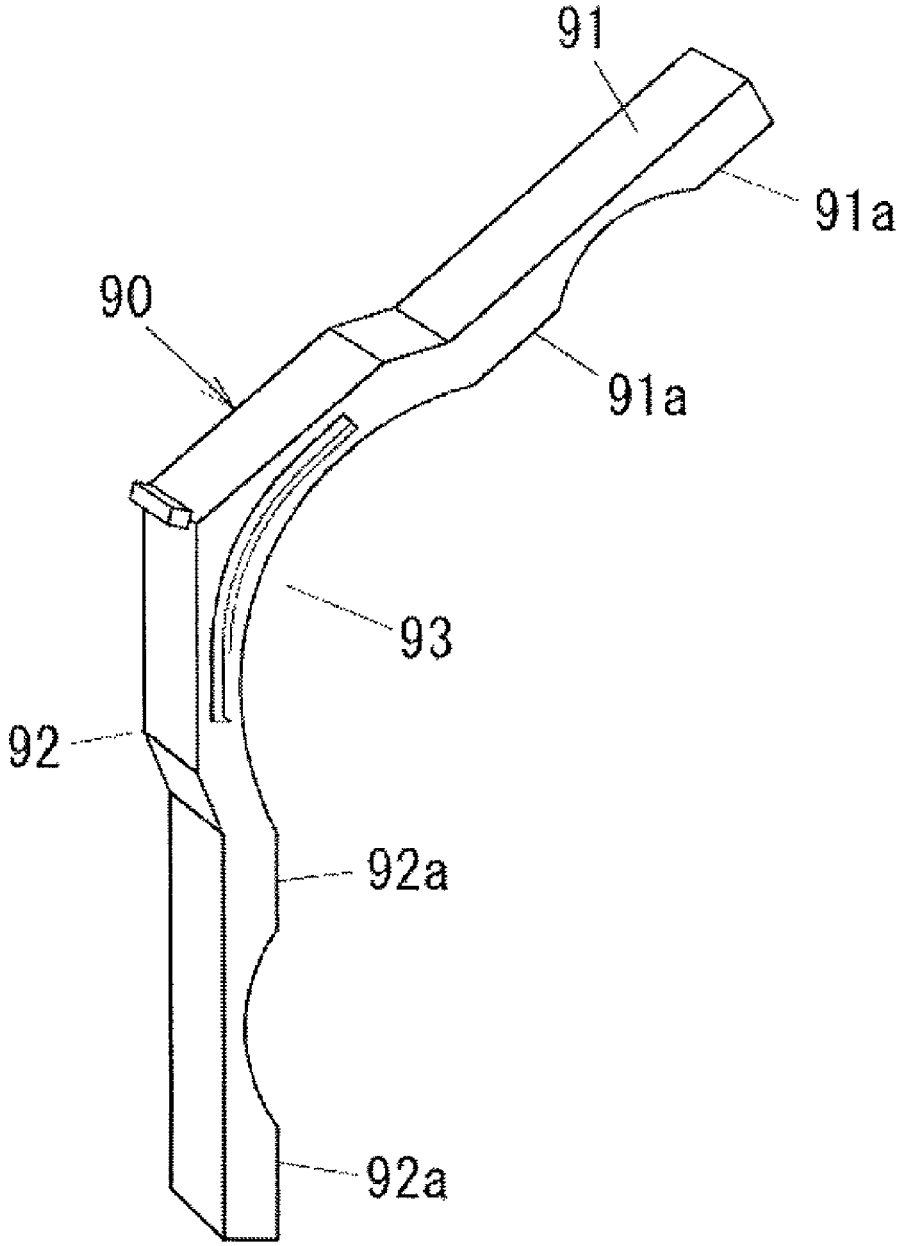
FIG. 7 shows a bevel square which is used in the first embodiment in this invention.

The suitable position of the seat 21 is defined by a position where the bending angle θ of the knee of the user M has a suitable angle. The suitable angle is, for example, 140 degrees. Therefore, when the user operates the operation input device 32*a*, the user needs to measure whether the bending angle θ of the knee has suitable angle or not. In order to measure the bending angle θ of the knee, the bending angle θ of the knee is measured by a bevel square 90 shown in FIG. 7. The bevel square 90 comprises a first part 91 and a second part 92. One end of the first part 91 is fixed to one end of the second part 92. The first part 91 is provided for meeting the front side of the femoral area. The second part 92 is provided for meeting the front side of the lower leg.

The first part 91 is provided with two contact sections 91*a* arranged in the longitudinal direction of the first part 91. The second part 92 is provided with two contact sections 92*a* arranged in the longitudinal direction of the first part 91. The top surface of each the contact sections 91*a* are parallel to a plane along the longitudinal direction of the first part 91. The top surface of each the contact sections 92*a* are parallel to a plane along the longitudinal direction of the second part 92. The top surfaces of the first part 91 are arranged within a first plane. The top surfaces of the second part 91 are arranged within a second plane which is different from the first plane. The first part 91 is shaped to make an angle of θ with the second part 92.

The first part 91 is coupled to the second part 92 at a cross part. The cross part is provided at its inside with a recess 93. The recess 93 has an inside surface which is faced to the front surface of the knee. The inside surface of the recess 93 has a concave curve. The recess 93 is shaped to prevent the front side of the knee from contacting to the bevel square 90 when the bevel square 90 is contacted to the front surface of the knee.

The bevel square 90 is used to put to the leg while the recess 93 is put to the front side of the knee. When the bending angle θ of the knee is equal to the suitable angle, the contact sections 91*a* of the first part 91 come into contact with the front surface of the femoral area. Similarly, when the bending angle θ of the knee is equal to the suitable angle, the contact sections 92*a* of the second part 92 come into contact with the front surface of the lower leg. Therefore, the user is able to recognize that the bending angle θ of the knee has the suitable angle by adjusting the bending angle θ of the knee as mentioned above.

Therefore, the user M adjusts the position of the seat 21 as follows. First, the user sits on the seat 21 and puts the bevel square 90 such that the two contact section 92*a* of the second part 92 comes into contact with the front side of the lower leg. Subsequently, the user enters the operation instruction of moving the seat 21 into the operation input device 32*a*. In this manner, the position of the seat is adjusted. Additionally, if the two contact section 91*a* of the first part 91 comes into contact with the front side of the femoral area, the bending angle θ of the knee is adjusted to the suitable angle. Therefore, the user stops moving the seat 21 by means of the operation input device 32*a*. In this manner, it is possible to adjust the position of the seat to the suitable position on the basis of the user M individually. In this way, the seat 21 is swung about the standard position by the seat driving unit. In this case, the standard position is located at a standard height measured from the foot support surface in the vertical direction.

In contrast, when the operation input device 32*a* receives the operation input of determining the position of the seat 21 after the position of the seat 21 is adjusted such that the bending angle θ of the knee has a suitable angle, the control unit 82 prohibits the seat height adjusting unit 60 to be moved on the basis of the operation input from the operation input device 32*a*. In contrast, the control unit 82 allows the operation of the seat 21 by the seat driving unit 50. Under the condition where the operation of the seat 21 is allowed, when the operation instruction is entered into the operation input device 32*a*, the control unit 82 controls the motor 71. Consequently, the seat driving unit 50 swings the seat 21. That is, the seat driving unit 50 is prohibited to swing the seat 21 until the operation input device 32*a* receives the operation input of determining the position of the seat 21. Therefore, the seat driving unit 50 is only swung after the user M adjusts the position of the seat 21 at the suitable position. Consequently, it is possible to prevent the start of the exercise carelessly while adjusting the bending angle θ of the knee to the suitable angle.

The control unit 82 comprises a memory (not shown). The memory stores a standard value of the rotation speed of the motor 71 when the seat 21 is located in a suitable position. In other words, the memory stores the standard value of the rotation speed of the motor 71 when the bending angle θ of the knee of the user M has the suitable angle. When the motor 71 rotates at a rotation speed of the standard value, the seat driving unit 50 swings the seat 21 at a predetermined cycle. (When the motor 71 rotates at the rotation speed of the standard value, the seat driving unit 50 swings the seat 21 at a standard speed.) In other words, the memory of the control unit 82 stores the standard value of the rotation speed of the motor 1 when the seat 21 is located in the standard position. In addition, when the motor 71 rotates at the rotation speed of the standard value, the seat driving unit 50 swings the seat at a predetermined cycle (standard speed).

Next, the essence of the operation in this invention when the bending angle θ of the knee of the user M is smaller than the suitable angle.

As mentioned above, first, the position of the seat 21 is adjusted to the suitable position according to individual differences of the user M. Subsequently, when the operation input device 32*a* receives the operation instruction of varying the position of the seat 21, the controller 82 prohibits the seat driving unit 50 to swing the seat 21, and allows the operation of the seat height adjusting unit 60. Then, the operation input of moving the seat 21 downward is received by the operation input device 32*a*, whereby the seat 21 is moved downward from the suitable position. In this manner, the bending angle θ of the knee is adjusted to a second angle (for example, 100 degrees) which is smaller than the suitable angle. Subsequently, the operation input of determining the position of the seat 21 is received by the operation input device 32*a*, the control unit 82 prohibits the seat height adjusting unit 60 to be operated on the basis of the operation instruction from the operation input device 32*a*, and allows the operation of the seat by means of the seat driving unit 50. When the operation input device 32*a* receives the operation input of starting the exercise under the condition where the operation of the seat is allowed, the control unit 82 controls the motor 71, whereby the seat driving unit 50 starts swing the seat 21. In this case, the control unit 82 stores a movement distance of the seat 21 from the suitable position to the memory. As the movement distance of the seat 21 is increased, the rotation speed of the motor 71 is reduced than the standard value corresponding to the suitable position. In other words, as the bending angle of the knee becomes smaller, the rotation speed of the motor 71 is reduced than the standard value corresponding to the suitable position. In this manner, the cycle of the swing of the seat by means of the seat driving unit 50 becomes longer relatively. In other words, the speed of the swing of the seat 21 by means of the seat driving unit 50 is reduced. That is, the load applied to the knee joint is increased as the bending angle θ of the knee become smaller than the suitable angle. Therefore, the cycle of the swing is prolonged as the bending angle θ of the knee becomes smaller relatively. In other words, the speed of the swing is reduced as the distance between the foot support surface 40*a* of the foot support 40 and the contact surface 21*a* of the seat 21 becomes shorter relatively. Consequently, it is possible to reduce the load applied to the knee joint of the user M. In other words, the control unit 82 which acts as the load regulating means is configured to control the seat driving unit such that the seat driving unit swings the seat at a cycle longer than the predetermined cycle as the distance between the contact surface and the foot support surface becomes smaller than the standard height. In this manner, it is possible to reduce the load applied to the knee joint of the user M by prolonging the cycle of the swing (reducing the speed of the swing). In particular, an acceleration of movement of the weight center of the human caused by the swing of the seat 21 is reduced. Therefore, the load applied to the legs is reduced.

As mentioned above, as the distance between the contact surface 21*a* and the foot support surface 40*a* becomes smaller relatively, the control unit 82 which defines the load regulating means prolongs the cycle of the swing of the seat 21, whereby reducing the load applied to the knee joint of the user M. That is, as the bending angle θ of the knee of the user M is reduced, the control unit 82 which defines the load regulating means prolongs the cycle of the swing of the seat 21, whereby reducing the load applied to the knee joint of the user M.

Consequently, it is possible to safely and effectively give the exercise to the user in a broad angle range of the joint. Furthermore, it is also possible to give the exercise to the user without applying the exceeding load to the knee joint.

It should be noted that it is preferred that the seat 21 is inclined to backward instead of prolonging the cycle of the swing of the seat 21 as the distance between the contact surface 21*a* and the foot support surface 40*a* becomes smaller relatively. A means of inclining the seat backward is, for example, realized by a rear link 56 which comprises a expansion and contraction mechanism. As the distance between the contact surface 21*a* and the foot support surface 40*a* becomes smaller relatively, the rear link 56 is contracted. Consequently, the seat 21 is inclined backward. Furthermore, it is also possible to employ the lifting base 61 which is provided at its top end with a swinging mechanism for swinging the seat driving unit 50 in the front-back direction. Consequently, a ratio of the weight of the user supported by the seat 21 is increased by inclining the seat 21 backward. Therefore, the user's weight acting on the legs is reduced, whereby the load applied to the knee joint is reduced.

Second Embodiment

In the first embodiment, the load applied to the knee joint of the user M is reduced by prolonging the cycle of the swing of the seat 21 or the inclining the seat backwardly. In contrast, the technical feature in the second embodiment resides in that the displacement amount of the seat is reduced as the distance between the contact surface 21*a* and the foot support surface 40*a* becomes shorter relatively. That is, the displacement amount of the seat is reduced as the height of the contact surface 21*a* measured from the foot support surface 40*a* becomes shorter than the standard height. It should be noted that the basic components of the second embodiment is common to the components of the first embodiment. Therefore, components which are identical with or similar to the components of the first embodiment will be denoted with the same reference numerals. Furthermore, explanation of the components which are identical with or similar to the components of the first embodiment will be omitted.

Figure 8:
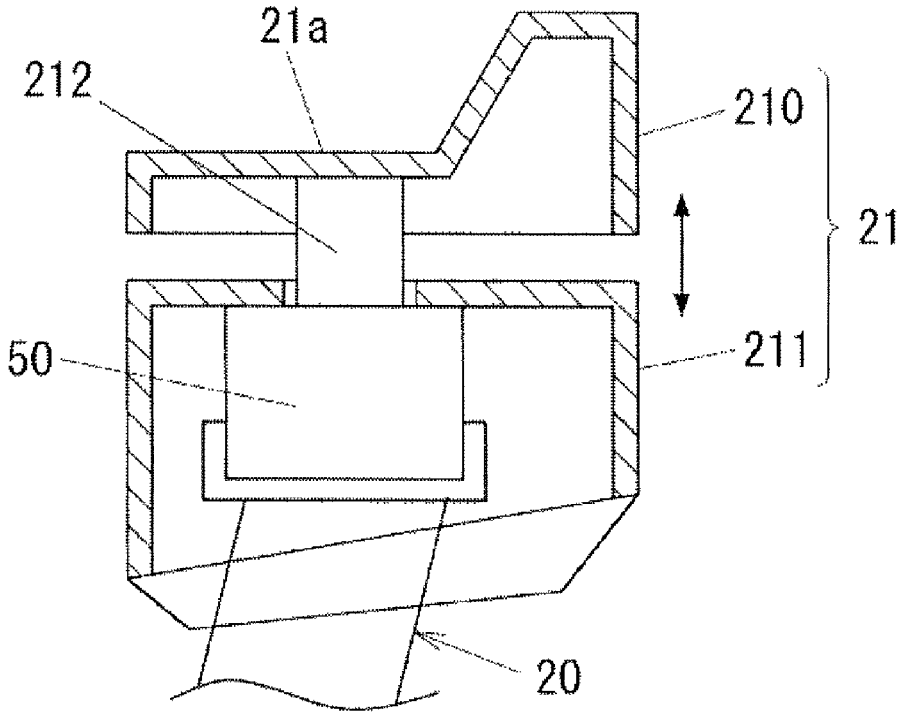
FIG. 8 shows a side view of the essential parts of the second embodiment in this invention.

In the seat driving unit 50 of this embodiment, the displacement amount of the seat driven to move by the seat driving unit 50 is reduced as the distance (in the vertical direction) between the seat driving unit 50 and the base plate 57 becomes shorter. Therefore, as shown in FIG. 8, the seat 21 is divided into two components. One of the two components is a seat upper half 210, and the other of the two components is a seat lower half 211. The seat lower half 211 is supported by the seat support 20. The seat upper half 210 is coupled to the seat lower half 211 by means of a lifting mechanism 212 such that the seat upper half 210 is movable upward and downward relative to the seat lower half 211. The lifting mechanism 212 is realized by, for example, a hydraulic lifting unit, a pneumatic lifting unit, and an electromagnetic lifting unit in addition to the mechanical lifting unit similar to the seat height adjusting unit 60. The lifting mechanism 212 is controlled by the control unit 82, whereby the seat upper half 210 is moved upward and downward. It is noted that the lifting units of the above are well known. Therefore, detail explanations of the lifting units are omitted.

Next, the operation, the essence of the invention, of the exercise assisting device being used under the condition where the bending angle θ of the knee of the user M is smaller than the suitable angle is explained.

As explained in the first embodiment, the seat 21 is moved to the position corresponding to the suitable position by means of the seat height adjusting unit 60 according to the individual differences of the user M. Then, when the operation instruction of varying the position of the seat is received by the operation input device 32*a*, the control unit 82 prohibits the operation of the seat 21 by means of the seat driving unit 50. Subsequently, the control unit 82 permits the operation of the seat 21 by means of the seat height adjusting unit 60. That is, as mentioned in the first embodiment, the seat height adjusting unit 60 moves the seat to the standard position according to the individual difference of the user M. At this time, the seat 21 is located at a position having the standard height measured from the foot support surface. Subsequently, when the operation input device 32*a* receives the operation input of varying the position of the seat 21, the control unit 82 prohibits the seat driving unit 50 to operate the seat 21. Further, the control unit 82 permits the seat height adjusting unit 60 to operate.

Subsequently, when the user M enters the operation instruction of moving the seat 21 downward into the operation input device 32*a*, the seat 21 is moved downward from the suitable position. When the operation input device 32*a* receives the operation instruction of determining the position of the seat 21 after the user set the bending angle θ as a adequate angle (for example, 100 degrees) which is smaller than the suitable angle, the control unit 82 controls the lifting mechanism 212 to move the seat upper half 210 downward. In other words, when the operation input device 32*a* receives the operation instruction of determining the position of the seat 21 after the user set the bending angle θ as a adequate angle (for example, 100 degrees) which is smaller than the suitable angle, the control unit 82 controls the lifting mechanism 212 to move the seat upper half 210 a first distance toward the seat lower half 211. In addition, the control unit 82 controls the seat height adjusting unit 60 in such a manner that the seat height adjusting unit 60 moves the seat a second distance upward, whereby whole of the seat 21 is moved upward. The first distance is equal to the second distance. In this manner, it is possible to shorten the distance between the seat upper half 210 and the seat lower half 211 while maintaining the seat at the same position. Then, the control unit 82 prohibits the seat height adjusting unit 60 to operate by the operation instruction from the operation input device 32*a*. Subsequently, the control unit 82 permits the seat driving unit 50 to operate the seat 21. When the operation input device 32*a* receives the operation instruction of starting the exercise under the condition where the seat 21 is permitted to be operated, the control unit 82 starts the motor 71 such that the seat driving unit 50 starts the swing of seat 21. Consequently, the distance between the base plate 57 of the seat driving unit 50 and the seat 21 becomes shorter than the case where the bending angle θ of the knee has a suitable angle. Therefore, the displacement amount of the seat 21 is relatively reduced. As the displacement amount becomes smaller, the load applied to the legs is reduced. As a result, the load applied to the knee joint of the user M is reduced.

In this manner, the distance between the contact surface 21*a* and the foot support surface 40*a* is relatively reduced. That is, as the bending angle θ of the knee of the user M becomes smaller, the control unit 82 defined as the load regulating means reduces the displacement amount of the seat 21, whereby the load applied to the knee joint of the user M is reduced. In other words, as the distance between the contact surface 21*a* of the seat 21 and the foot support surface 40*a* becomes smaller, the control unit 82 defined as the load regulating means reduces the displacement amount of the seat 21. Consequently, the load applied to the knee joint of the user M is reduced. As a result, it is possible to obtain the exercise assisting device being configured to give the exercise to the user without applying exceeding load to the knee joint in addition to give the exercise safely and effectively to the user under broad angle range of the knee joint.

Third Embodiment

The feature of the third embodiment resides in the seat driving unit 50. Therefore, components other than the seat driving unit 50 are common to the components shown in the first embodiment. Therefore, the components common to the components of the first embodiment is denoted by the same reference numerals. Furthermore, the explanation of the components common to the components of the first embodiment is omitted.

Figure 9A:
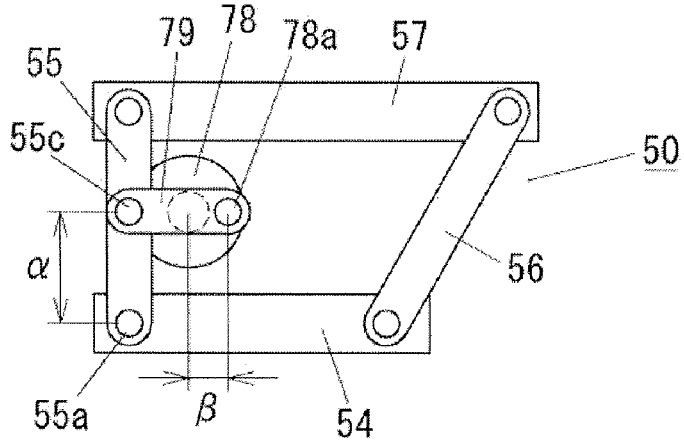
FIG. 9*a* shows a side view of a third embodiment in this invention.

As shown in FIG. 9*a*, the displacement amount of the seat 21 by means of the seat driving unit 50 is varied by adjusting at least one of a distance a or a distance B explained below. That is, the distance a is defined by a distance between "the axial pin 55*a* of the front link 55 which is pivotally fixed to one end of the arm link 79" and the "front shaft 55*a* of the front link 55 which is pivotally fixed to the left frame plate 54*a* and the right frame plate 54*b*". The distance B is defined by a distance between "a shaft 78 pivotally fixed to one end of the arm link 79" and "a center of the eccentric crank 78 attached to one end of the first shaft 73". The distance 13 is, in other words, the eccentricity B. It should be noted that FIG. 9 shows the simplified seat driving unit 50. Therefore, the components of such as the front link 55, the eccentric crank 78, the left frame plate 54*a*, and the right frame plate 54*b* are slightly modified. However, basic configuration and the operation is same as the seat driving unit 50.

In this embodiment, the seat driving unit 50 comprises at least one of a first mechanism and a second mechanism. The first mechanism is configured to vary the distance a between the front shaft 55*a* and the axial pin 55*c*. The second mechanism is configured to vary the eccentricity B of the eccentric crank 78. With this configuration, it is possible to vary the displacement amount of the seat 21.

Figure 9B:
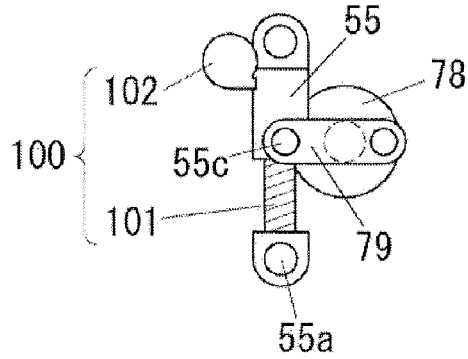
FIG. 9*b* shows a side view of essential parts of the seat driving unit in the third embodiment.
Figure 9C:
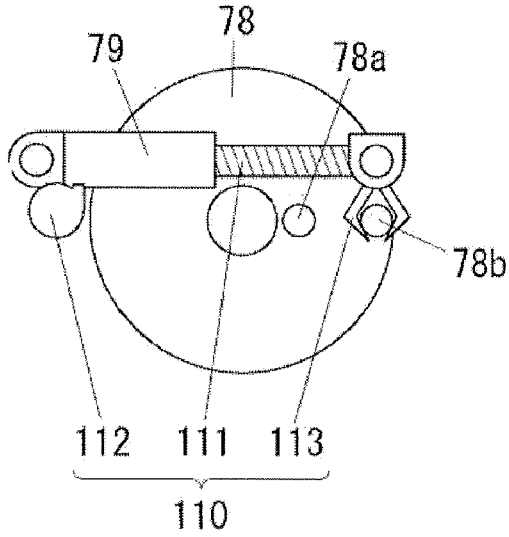
FIG. 9*c* shows a side view of essential parts of the seat driving unit in the third embodiment.

The first mechanism 100 is shown in FIG. 9*b*. The first mechanism 100 comprises a piston 101 and a pump 102. The piston 101 realized by a pneumatic type piston, and is disposed between the front shaft 55*a* and the axial pin 55*c*. The pump 102 is controlled by the control unit 82 so as to drive the piston 101. When the piston 101 is driven by the pump 102, the distance a between the axial pin 55*c* and the front shaft 55*a* is varied. The second mechanism 110 is shown in FIG. 9*c*. The second mechanism 110 comprises a piston 111, a pump 112, and a clip 113. The piston 111 is realized by a pneumatic type piston. The piston 111 is held by the arm link 79. The pump 112 is controlled by the control unit 82 so as to drive the piston 111. The clip 113 is shaped to hold one of the shafts. (In this embodiment, the clip 113 is shaped to hold either one of the shaft 78*a* and the shaft 78*b*. When the piston 111 is operated by the pump 112, the distance (eccentricity) B between "either one of the shaft 78*a* or the shaft 78*b* pivotally fixed to one end of the arm link 79" and "the center of the eccentric crank 78" is varied. Needless to say, a motor and a feed screw may be employed instead of the pistons 101, 111 and the pump 102, 112.

With this configuration, when "(a) the distance a between the axial pin 55*c* and the front shaft 55*a* of the front link 55 is shortened by means of the first mechanism 100" or "(b) the eccentricity B of the eccentric crank 78 is increased by means of the second mechanism 110", the displacement amount (swing amount) of the seat by the seat driving unit 50 is increased. In contrast, when "(c) the distance a between the axial pin 55*c* and the front shaft 55*a* of the front link 55 is increased by means of the first mechanism 100" or "(d) the eccentricity B of the eccentric crank 78 is reduced by means of the second mechanism 110", the displacement amount (swing amount) of the seat by the seat driving unit 50 is reduced.

In this manner, as the distance between the contact surface 21*a* of the seat 21 and the foot support surface 40*a* becomes shorter, the control unit 82 defined as the load regulating means controls at least one of the first mechanism 100 and the second mechanism 110 so as to reduce the displacement amount of the seat 21. In other words, as the bending angle θ becomes smaller, the control unit 82 defined as the load regulating means controls at least one of the first mechanism 100 and the second mechanism 110 so as to reduce the displacement amount of the seat 21. Consequently, the load applied to the legs of the user M is reduced, whereby the load applied to the knee joint is reduced. As a result, it is possible to obtain the exercise assisting device being configured to give the exercise to the user M without applying exceeding loads to the knee joint in addition to give the exercise safely and effectively to the user M in the broad angle range of the knee joint.

Fourth Embodiment

Figure 10:
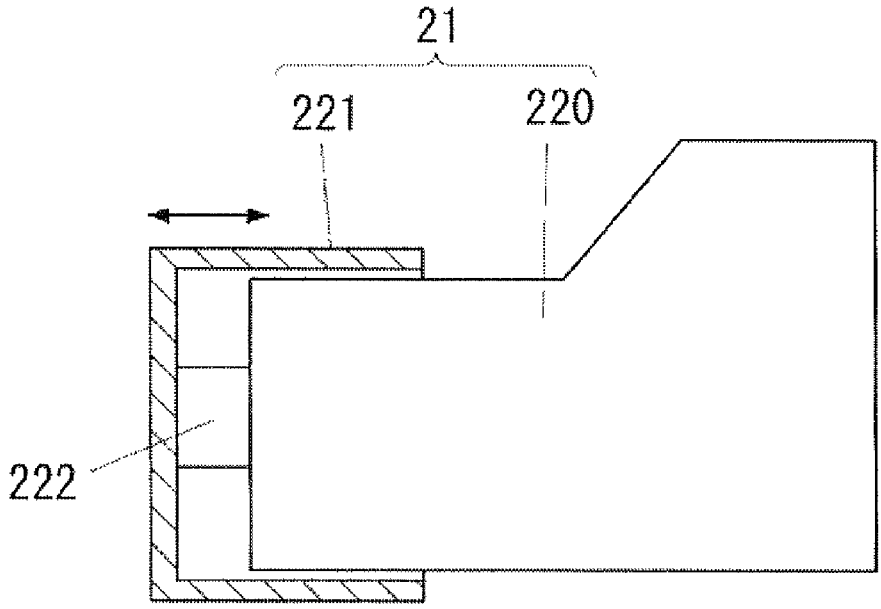
FIG. 10 shows a side view of the seat in a fourth embodiment in this invention.

The seat driving unit 50 in this embodiment is configured to increase the contact surface 21*a* in order to increase the ratio of the weight of the user M supported by the seat 21, whereby it is possible to reduce the load which acts on the legs so as to reduce the load applied to the knee joint. That is, as shown in FIG. 10, the seat 21 is divided into two components being composed of a seat main body 220 and a front unit 221. The seat main body 220 is supported by the seat support 20. The front unit 221 is attached to a front section of the seat main body 220 via an extending mechanism 222 such that the extending mechanism moves the front unit 221 frontward and backward relative to the seat main body 220. The extending mechanism 222 is realized by a hydraulic extending unit, a pneumatic extending unit, an electromagnetic extending unit, and a mechanical extending unit similar to the seat height adjusting unit 60. The controller 82 is configured to control the extending unit such that the front unit 221 is moved frontward and the backward. These extending units mentioned above are well known, whereby the detail explanations of the configurations of the extending units are omitted.

With this configuration, as the extending mechanism 22 extends frontward, the movement distance of the front unit is increased, whereby the contact surface 21*a* of the seat 21 is increased.

As mentioned above, as the distance between the contact surface 21*a* of the seat 21 and the foot support surface 40*a* is shortened relatively, the control unit 82 defined as the load regulating means controls the extending mechanism 222 so as to move the front unit 221 frontward. That is, as the bending angle θ of the knee of the user M becomes smaller, the control unit 82 defined as the load regulating means controls the extending mechanism 222 so as to move the front unit 221 frontward. In other words, as the distance between the contact surface 21*a* of the seat 21 and the foot support surface 40*a* becomes shorter, the control unit 82 defined as the load regulating means controls the extending mechanism 222 so as to move the front unit 221 frontward. Consequently, much of the weight of the user M is supported by the seat 21. As a result, the load applied to the knee joint of the user M is reduced.

Therefore, it is possible to give the exercise to the user without applying the exceeding load to the knee joint in addition to give the exercise the user safely and effectively in the broad angle range of the joint angle. As a matter of course, the means of increasing the contact surface 21*a* of the seat 21 is not limited to the means of moving the front unit 221 frontward. For example, it is possible to employ the seat 21 which is divided into two members of a seat left half and a seat right half. In this case, the extending mechanism is configured to move at least one of the seat left half and the seat right half leftward or rightward. This configuration also makes it possible to increase the contact surface 21*a*.

Fifth Embodiment

Figure 11:
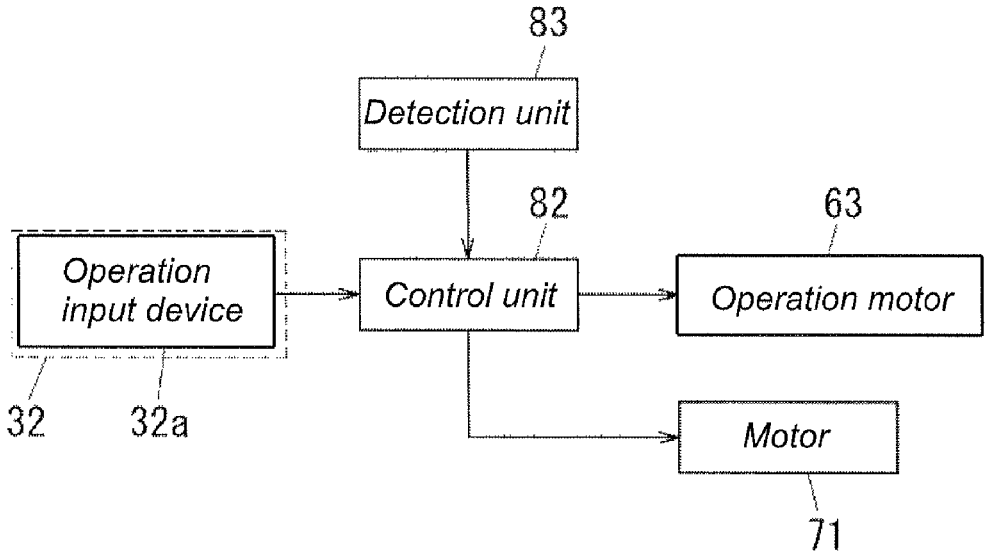
FIG. 11 shows a block diagram of essential parts in the fifth embodiment in this invention.

The fifth embodiment shown in FIG. 11 comprises a detection unit 83. The detection unit 83 is configured to detect muscle activities of the legs of the user M. Position in the vertical direction of the contact surface 21*a* of the seat 21 is adjusted according to the result of the muscle activities detected by the detection unit 83. The components other than detection unit 83 and the control unit 82 are common to the components in the first embodiment to the fourth embodiment. Therefore, explanation of the components similar to the components in the first embodiment to the fourth embodiment is omitted.

The detection unit 83 is exemplified by the well known means such as an electromyography and a muscle hardness meter. The electromyography is configured to detect the active contraction of the muscle electrically. The muscle hardness meter is configured to detect the active contraction of the muscle mechanically. The detection unit 83 is configured to convert the detection value of the muscle activities into the electrical signal (detection signal), and subsequently sends the electrical signal to the control unit 82. it should be noted that the detection unit 83 is preferably configured to detect the muscle activities of at least one of rectus femoris muscle, a medial great muscle, and a lateral vastus muscle.

The control unit 82 is configured to estimate an actual load applied to the legs of the user M in order to generate an estimation value indicative of the actual load applied to the legs of the user M on the basis of the detection signal sent from the detection unit 83. Subsequently, when the estimation value exceeds an adequate range determined by parameter of the user's age, gender, and the body type (such as body weight and body height), the control unit 82 controls the operation motor 63 so as to move the position of the seat 21 upward, whereby the bending angle θ of the knee is increased.

As mentioned above, in a case where the user voluntarily exercises with the bending angle θ of the knee is smaller than the suitable angle, when the load actually applied to the legs estimated by the result of the muscle activities detected by the detection unit 83 exceeds the adequate range, the control unit 82 adjusts the distance between the seat 21 and the foot support surface 40*a*. In other words, the control unit 82 adjusts the position of the seat 21 in the vertical direction. In short, the control unit 82 adjusts the bending angle θ of the knee of the user M. Consequently, it is possible to obtain the exercise assisting device being configured to give the exercise load to the muscle while maintaining the safety.

Although the present invention is described with particular reference to the above illustrated embodiments, the present invention should not be limited thereto, and should be interpreted to encompass any combinations of the individual features of the embodiments.

The invention claimed is:

1. An exercise assisting device comprising:

foot supports having foot support surfaces respectively, each said foot support is provided for bearing a foot of a user;

a seat being shaped to have a contact surface for supporting buttocks of the user when the user places the feet onto said foot support surfaces;

a seat height adjusting unit being configured to move said seat toward a vertical direction and also toward a front-back direction in order to position said seat at a standard position which is located at a standard height from said foot support surface in the vertical direction, whereby a knee of the user has a predetermined angle, a seat driving unit being configured to swing said seat about the standard position so as to vary weight of the user which acts on legs of the user, wherein the exercise assisting device further comprises a load regulating means being configured to vary a load which acts on a knee joint of the user as a height between said contact surface of said seat and said foot support surface in the vertical direction becomes shorter than the standard height, wherein said seat driving unit is configured to swing said seat about the standard position at a variable cycle, and being configured to swing said seat about the standard position at a predetermined cycle when said seat is located at the standard height from said foot support surface, said load regulating means being configured to control said seat driving unit such that said seat driving unit swings said seat at a cycle being longer than said predetermined cycle as the height of said seat from said foot support surface becomes shorter than the standard height.

2. The exercise assisting device as set forth in claim 1, wherein said load regulating means comprises a detector and a controller, said detector being configured to detect a muscle activities of the legs of the user, said controller being configured to control said seat height adjusting means such that said seat being positioned to have an adjusted height which is determined on the basis of the muscle activities of the legs of the user.

3. The exercise assisting device as set forth in claim 2, wherein said detector being configured to detect the muscle activities of specified muscle, and said specified muscle is at least one of a rectus femoris muscle, a medial great muscle, and a lateral vastus muscle.

4. An exercise assisting device comprising:

foot supports having foot support surfaces respectively, each said foot support is provided for bearing a foot of a user;

a seat being shaped to have a contact surface for supporting buttocks of the user when the user places the feet onto said foot support surfaces;

a seat height adjusting unit being configured to move said seat toward a vertical direction and also toward a front-back direction in order to position said seat at a standard position which is located at a standard height from said foot support surface in the vertical direction, whereby a knee of the user has a predetermined angle, a seat driving unit being configured to swing said seat about the standard position so as to vary weight of the user which acts on legs of the user, wherein the exercise assisting device further comprises a load regulating means being configured to vary a load which acts on a knee joint of the user as a height between said contact surface of said seat and said foot support surface in the vertical direction becomes shorter than the standard height, wherein said seat driving unit is configured to swing said seat about the standard position so as to displace said seat at a displacement amount which is variable, said seat driving unit being configured to swing said seat at a predetermined displacement amount when said seat is located at the standard height from said foot support surface, said load regulating means being configured to control said seat driving unit such that said seat driving unit swings said seat at a displacement amount which is lesser than the predetermined displacement amount as the height of said seat from said foot support surfaces becomes shorter than the standard height.

5. The exercise assisting device as set forth in claim 4, wherein said load regulating means comprises a detector and a controller, said detector being configured to detect a muscle activities of the legs of the user, and said controller being configured to control said seat height adjusting means such that said seat being positioned to have an adjusted height which is determined on the basis of the muscle activities of the legs of the user.

6. The exercise assisting device as set forth in claim 5, wherein said detector being configured to detect the muscle activities of specified muscle, and said specified muscle is at least one of a rectus femoris muscle, a medial great muscle, and a lateral vastus muscle.

7. An exercise assisting device comprising:

foot supports having foot support surfaces respectively, each said foot support is provided for bearing a foot of a user;

a seat being shaped to have a contact surface for supporting buttocks of the user when the user places the feet onto said foot support surfaces;

a seat height adjusting unit being configured to move said seat toward a vertical direction and also toward a front-back direction in order to position said seat at a standard position which is located at a standard height from said foot support surface in the vertical direction, whereby a knee of the user has a predetermined angle, a seat driving unit being configured to swing said seat about the standard position so as to vary weight of the user which acts on legs of the user, wherein the exercise assisting device further comprises a load regulating means being configured to vary a load which acts on a knee joint of the user as a height between said contact surface of said seat and said foot support surface in the vertical direction becomes shorter than the standard height, wherein said load regulating means being configured to incline said seat toward a back direction as a height of said seat from said foot support surface becomes shorter than the standard height.

8. The exercise assisting device as set forth in claim 7, wherein said load regulating means comprises a detector and a controller, said detector being configured to detect a muscle activities of the legs of the user, and said controller being configured to control said seat height adjusting means such that said seat being positioned to have an adjusted height which is determined on the basis of the muscle activities of the legs of the user.

9. The exercise assisting device as set forth in claim 8, wherein said detector being configured to detect the muscle activities of specified muscle, and said specified muscle is at least one of a rectus femoris muscle, a medial great muscle, and a lateral vastus muscle.

* * * * *